US008695869B2

(12) United States Patent
Goto

(10) Patent No.: US 8,695,869 B2
(45) **Date of Patent: *Apr. 15, 2014**

(54) PACKAGING CONTAINER

(71) Applicant: Mito Saien Corporation, Mito (JP)

(72) Inventor: Norio Goto, Mito (JP)

(73) Assignee: Mito Saien Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/804,054

(22) Filed: Mar. 14, 2013

(65) Prior Publication Data

US 2013/0251289 A1 Sep. 26, 2013

Related U.S. Application Data

(63) Continuation of application No. 12/297,021, filed as application No. PCT/JP2007/058056 on Apr. 12, 2007, now Pat. No. 8,403,561.

(30) Foreign Application Priority Data

Apr. 13, 2006 (JP) ..... 2006-111112

(51) Int. Cl.
*B65D 5/00* (2006.01)

(52) U.S. Cl.
USPC ..... 229/116; 383/207; 383/907

(58) Field of Classification Search
USPC ..... 229/116, 213, 216, 241, 243, 244; 206/436; 383/208
See application file for complete search history.

(56) References Cited

U.S. PATENT DOCUMENTS 3,552,631 A * 1/1971 Fuchs ..... 229/123.1
3,734,388 A 5/1973 Hopkins
3,923,238 A * 12/1975 Thomas ..... 229/198.2

* cited by examiner

*Primary Examiner* — Gary Elkins
*Assistant Examiner* — Christopher Demeree
(74) *Attorney, Agent, or Firm* — Bruzga & Associates; Charles E. Bruzga; Jay S. Pattumudi

(57) ABSTRACT

The packaging container includes a bag assembly having first and second sealing sections formed at two opposite sides of four sides, and a third sealing section where one side of the remaining two sides is a folding line, wherein the one remaining side is opened. The opened side is joined together in a state in which an object is placed inside the bag assembly, a fourth sealing section is formed at an angle substantially orthogonal to the third sealing section, a pair of first and second triangles with the fourth sealing section as the shared bottom side are formed, and a pair of third and fourth triangles with the third sealing section as the shared bottom side are formed. The first and second sealing sections located on the vertical lines of the first and second triangles are used as an unsealing guide for tearing.

10 Claims, 11 Drawing Sheets

PACKAGING CONTAINER

TECHNICAL FIELD

The present invention relates to a packaging container, and particularly relates to a packaging container that can be easily unsealed.

BACKGROUND ART

Generally, a wide range of commercial goods are packaged in a square-shaped bag with an opening on one side of the bag from which it is possible to remove the contents. The opened bag remains box shaped, and functions as the packaging material until the contents are consumed. On the other hand, a tetrahedral packaging material in which the direction of one side is orthogonal to the direction of the opposite side is known as the so-called tetra-type packaging material (trade name: Tetra Pak).

There are many patent applications related to packaging material such as the following four applications:

Patent Document 1: Japanese Laid-open Patent Application No. 2005-138899;

Patent Document 2: Japanese Laid-open Patent Application No. 2000-264348:

Patent Document 3: Japanese Laid-open Patent Application No. 2000-153871; and

Patent Document 4: Japanese Laid-open Patent Application No. 9-30559.

For example, in Patent Document 1, a food-grade packaging bag is described in which a circuitous part that protrudes upward to a perforated line for unsealing is provided, and the bag can be easily opened by opening the circuitous part to the left and right. In Patent Document 2, a structure is described in which an adhesive material is interposed between the lid and the trunk of the packaging bag assembly to facilitate unsealing.

On the other hand, a tubular packaging material with a backing member having constant width tearing property is described in, e.g., Patent Document 3 as a packaging material that facilitates unsealing, and a packaging material having excellent tearing characteristics is described in Patent Document 4 in which a film having tearing characteristics is sandwiched and laminated by different tearing-type films. However, these packaging materials have the following technical problems.

DISCLOSURE OF THE INVENTION

Problems to be Solved by the Invention

In other words, the packaging material known in the prior art described above is provided tearing characteristics by using a special configuration or structure in which a special shape is added to the perforation line in order to facilitate unsealing, adhesive material is interposed between the trunk and the lid of a packaging bag assembly, a backing member having constant width tearing property is provided, and tearing-type films are sandwiched and laminated by different films. However, with such means, the configuration and structure become complex and there is the problem that costs are incurred and labor is required.

The present invention was contrived in view of such conditions, and an object thereof is to provide a packaging container produced in a process in which a packaging object is accommodated and a necessary sealing section is used as an unsealing guide for tearing when a bag assembly with one open end is manufactured, whereby unsealing is facilitated without the adoption of special means.

Means Used to Solve the Above-Mentioned Problems

In order to accomplish the above-stated object, the present invention provides a packaging container having a tetrahedral shape formed by closing two sides of a pair facing each other and one side of the other two sides facing each other by using the first through third sealing sections, and provided with a fourth sealing section that is substantially orthogonal to the third sealing section in a state in which a packaging object is placed in a bag having the remaining one side open, whereby the opening is sealed, the packaging container being characterized in that the first and the second sealing sections are used as an unsealing guide for tearing of the packaging container.

In accordance with the packaging container of the above-stated configuration, since the first and second sealing sections provided with two facing sides are used as an unsealing guide for opening by tearing of the packaging container when a bag assembly that has one open side is formed, unsealing is facilitated without the adoption of special means.

The first and second sealing sections can be composed of a heat-seal line. The packaging container has first and second triangular shapes in which the fourth sealing section is used as a shared bottom side, and third and fourth triangular shapes in which the third sealing section is used as a shared bottom side, and is formed in a tetrahedral shape in which the oblique skies of all the triangular shapes adjacent in the circumferential direction are connected; and the first and second sealing sections can be positioned on a perpendicular line of the first and second triangular shapes. When unsealed via an unsealing guide for tearing, the packaging container can be formed in a boat shape in a state in which the packaging object is placed, and the spread-out boat shape functions as a vessel that holds the contents and functions as a graspable dish in the case that the contents are food items. The packaging container is positioned in the center section of the fourth sealing section, and is provided with an easy-open section composed of a notched section, a perforated line, a hole, or the like positioned on an extension of the unsealing guide section.

The packaging container can be formed from a material that transmits a low level of UV rays. The packaging object may, in principle, be any object, and may be lettuce, spinach, or another vegetable. The packaging container may be provided with a plurality of chambers inside the packaging container that are partitioned by pockets or walls that are simultaneously unsealed when the packaging container is unsealed along the unsealing guide for tearing, and may be designed so that the contents of the plurality of the pockets or chambers appear when the packaging container is unsealed.

The packaging container has air internally sealed together with the packaging object, and a corner-pull seal line can be provided to each corner section of the packaging container. The corner-pull seal line can be formed as a circular arc or straight line that connects between the first and second sealing sections and the third and fourth sealing sections.

Effect of the Invention

In accordance with a packaging container of the present invention, the opening of a packaging container is facilitated without adopting special means because a first and a second sealing section provided with two facing sides act as an unsealing guide for tearing the packaging container when the bag assembly with one side opened is formed. The packaging container functions not only as the packaging of the articles, but is also one in which a package material is spread out in the shape of boat and the boat shape produced by the spreading functions as a vessel for contents when the packaging container filled with contents is unsealed. In the case that the contents are food items, the boat shape serves as a type of plate, and food items placed thereon can be eaten from this boat shape. The packaging container of the present invention functions merely not only as a package, but also additionally functions as a vessel for holding and grasping the contents. An application is also possible in which pockets and partitions are provided and the different contents are placed therein.

DESCRIPTION OF THE NUMERICAL SYMBOLS

Figure 1:
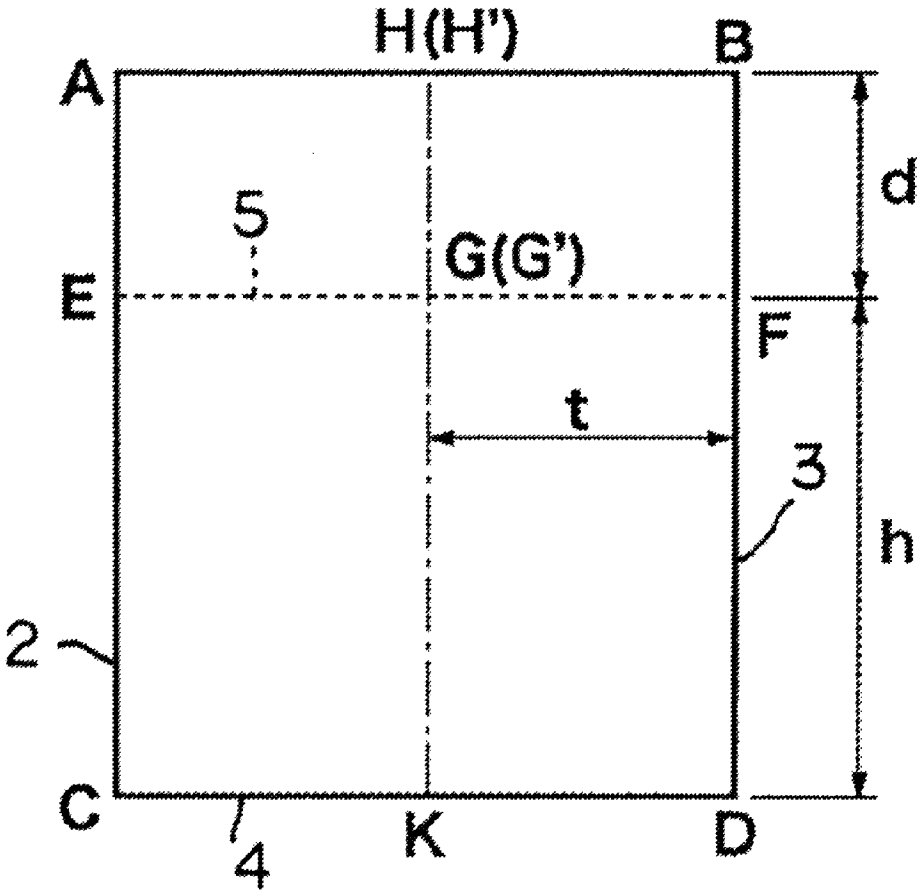
FIG. 1 is a view showing an example of a bag assembly used as a packaging container of the present invention.

1 bag assembly
2 first sealing section
3 second sealing section
4 third sealing section
5 fourth sealing section
6 packaging container
11, 12 reinforcement sections
13 band
14 cut
16, 17 oblique surfaces

BEST MODE FOR CARRYING OUT THE INVENTION

Embodiments of the present invention are described below. However, the present invention is not limited thereto. FIGS. 1 through 5 show an embodiment of the packaging container according to the present invention. FIG. 1 shows a tetrahedral bag assembly 1. A side AB is open and the other sides are sealed. Ordinarily, the contents are added from the open section of A-B, and A-B is then sealed to form a packaging container. In contrast, in the present invention, A-B is not immediately sealed, but rather the corners A and B are brought together, joined so that the direction of the side A-B and the direction of a side C-D are substantially orthogonal, and sealed in this state. This is widely known as a so-called tetra-type packaging material, and example thereof is Tetra Pak, which is a registered trade name.

A side A-C is a first sealing section 2, a side B-D is the second sealing section 3, and these sealing sections 2, 3, are formed from a folding line, a heat-seal line, a perforated line, or the like. The side C-D is a third sealing section 4, and a portion sealed at an angle substantially orthogonal to the side C-D is a fourth sealing section 5. The present invention will be described with reference to a square-shaped packaging container, but the shape of the bag is not limited to a square shape and the shape can also be trapezoidal.

The side A-C and the side B-D are, respectively, the first sealing section and the second sealing sections 2, 3 composed of a folding line, a heat-seal line, a perforated line, or the like in FIG. 1. The corners A, B are the two end corner sections of the upper side. The seal lines of the first and second sealing sections 2, 3 are the unsealing guide as described below. A notched portion, perforated line, hole, or another easy-open section may be provided to the bonded and sealed portion in which the corners A, B are brought together, and a reinforcement section formed by hot fusion, by a reinforcement member, or the like can also be provided to the periphery of the corners C, D.

Figure 2B:
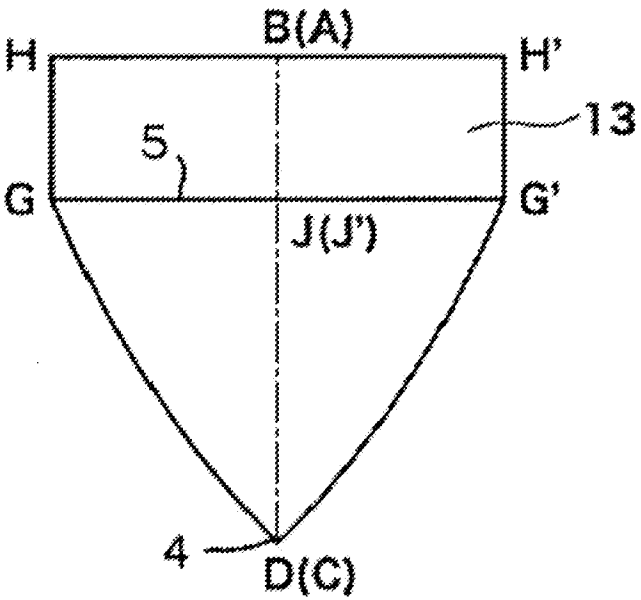
FIG. 2B is second lateral view of one of two different directions of the packaging container of the present invention.

As shown in FIG. 2B, the corner A and the corner B are brought together and joined to seal the open section so that the direction of the side A-B is substantially orthogonal to the direction of the side C-D. This sealing section acts as a fourth sealing section 5. H-H' (facing side), which is the center point of the side A-B, forms a corner, and the original corner A and the original corner B (facing side) are the center point of the side H-H' in a state in which the corners A and B have been brought together and sealed so that the side A-B is orthogonal to the direction of the side C-D. It is also possible to provide a band 13 toward a corner D downward from the side H-H', and to seal a side G-G' below the band 13.

In FIG. 2B, J is a focus point underneath the band 13, and J' is a focus point underneath the band 13 of the facing side. As a result, the side A-B enters a state substantially orthogonal to the side C-D to form a tetrahedral packaging container. Specifically, a first triangle (GG'C) and a second triangle (GG'D) are formed as a pair in which the side G-G' that is the fourth sealing section 5 serves as the shared bottom side; and a third triangle (CDG) and a fourth triangle (CDG') are formed as a pair in which the side C-D that is the third sealing section 4 serves as a shared bottom side to produce a tetrahedral packaging container in which the diagonals of the triangular shapes adjacent in the peripheral direction are connected to each other. A diagram of a tetrahedral packaging container 6 is shown in FIG. 3.

Figure 2A:
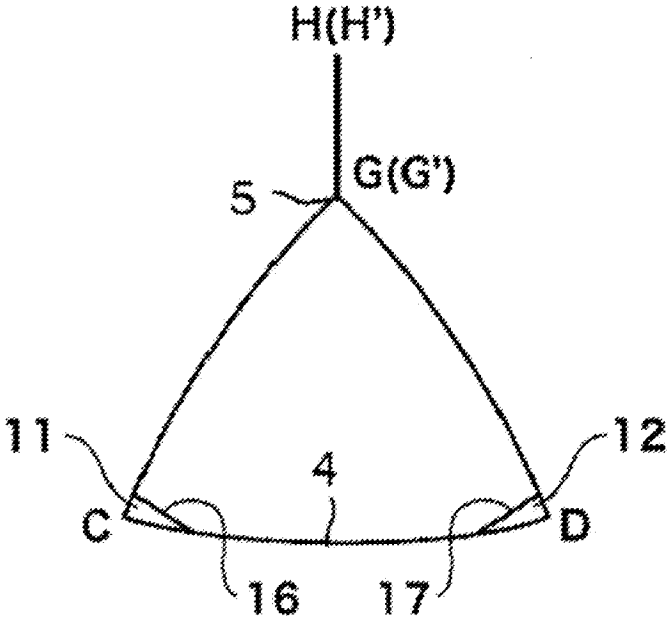
FIG. 2A is a first lateral view of one of two different directions of the packaging container of the present invention.

FIG. 2A is a view as seen from the original plane ABDC and FIG. 2B is a view as seen from an angle rotated 90 degrees from the surface of the original ABCD. Since the packaging container 6 is formed as a tetrahedral structure, there is resistance to external pressure and the contents can be dearly viewed when a transparent material is used as the material that forms the bag assembly 1. Nitrogen or carbon gas is sealed in the packaging container 6 as necessary, and the degradation of freshness of the contents can be prevented.

A resin film or resin sheet can be used as the material for the bag assembly 1. Examples of a resin that may be used include polyethylene, polypropylene, and other polyolefins; and polyester, polyamide, polycarbonate, polystyrene, poly-vinyl chloride, polyvinylidene chloride, a copolymer of ethylene and vinyl alcohol (trade name: EVAL), and the like. A double layer or triple layer (multilayer) laminate can also be used as necessary. In addition, a resin to which a UV absorber has been added may be used to reduce the transmissivity of UV rays.

Figure 3:
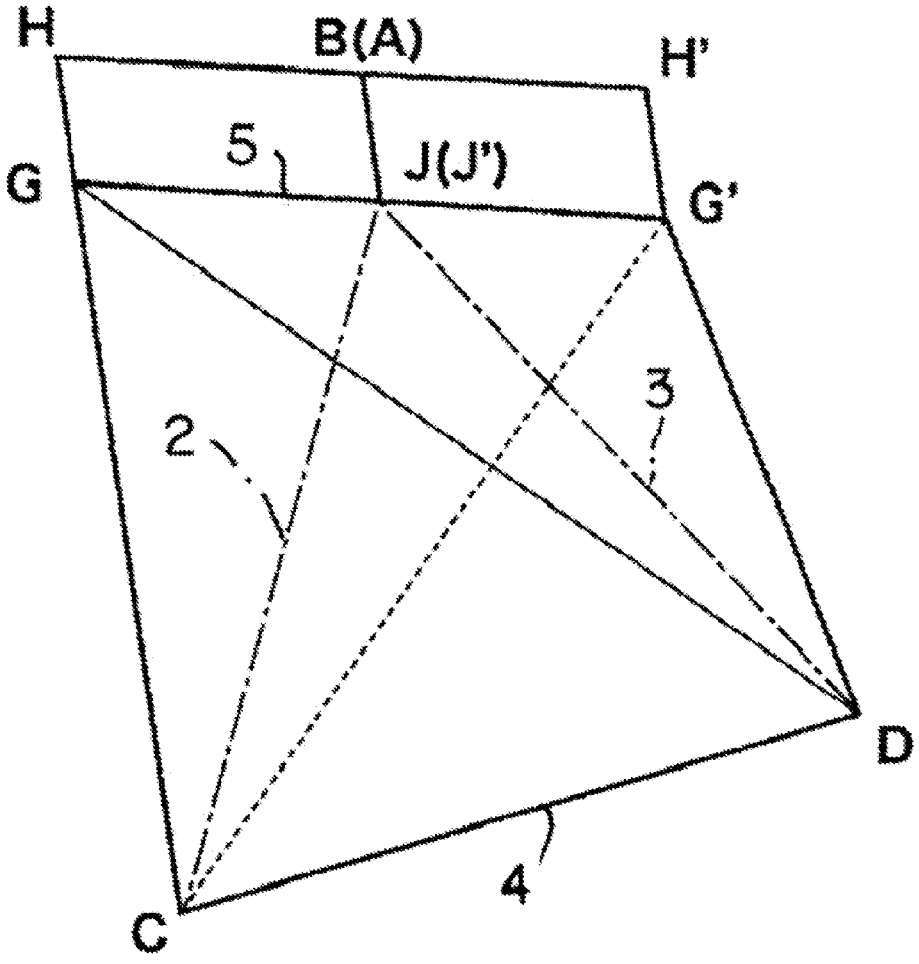
FIG. 3 is a perspective view of the packaging container of the present invention.
Figure 4:
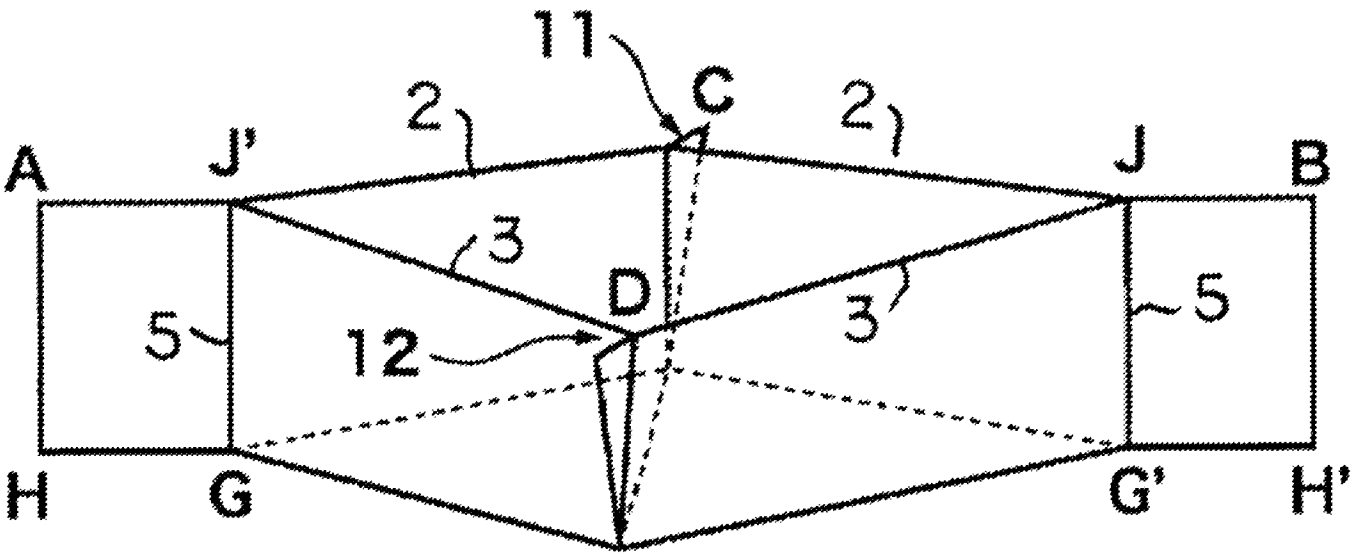
FIG. 4 is a descriptive view of the packaging container of the present invention in an unsealed state.

In the tetrahedral packaging container 6 shown in FIG. 3, the first and second sealing sections 2, 3 that were provided for forming the bag assembly 1 are positioned above the substantially perpendicular line of the first triangle (GG'C) and the second triangle (GG'D) pair in which the fourth sealing section 5 is used as the shared bottom side GG'. The first and second sealing sections 2, 3 act as an unsealing guide for tearing of the packaging container 6. When gradually unsealed (torn) along this unsealing guide, a boat shape is formed as shown in FIG. 4.

The packaging container spread out to a boat shape has a base length 2*h*, a height (depth) t at the bow and stern, and forms a boat shape (plate shape) with a depth that is less than t in accordance with the degree of the widening of the boat shape at the center of the boat shape. Note that h is obtained by subtracting a width d of the band 13 from the length of the package bag, as shown in FIG. 1, d is the width of the band 13, and t is the size of half the width of the package bag ABDC. A portion of the band 13 forms the ear portion of the boat shape, contributes to holding the shape of the boat, and makes the packaging container convenient to grasp. The boat shape produced in this case holds the contents unchanged in the middle of the boat shape and functions as a kind of vessel. The boat shape functions as a kind of food vessel, e.g. a plate. For example, as long as the contents are an object such as lettuce already washed and cut to a suitable size, the lettuce is held in the boat-shaped vessel (plate), a suitable dressing is applied, and the lettuce can be eaten using the boat shape as a plate after the package has been unsealed.

In the boat shape, the corners C, D of the original bag ABDCD are positioned in the center of the upper section of the boat shape. Since this portion is a factor that causes the shape of the boat to become unstable, the portions on the periphery of sides C, D are preferably reinforced in advance. In other words, reinforcement sections indicated by the reference numerals 11, 12 in FIG. 2A are provided. In the case of the present embodiment, the reinforcement sections 11, 12 having a triangular shape are being provided to the periphery of the corners C, D. In the reinforcement sections 11, 12, substantially the entire triangularly shaped surfaces may be fused, or only the oblique side sections 16, 17 of the triangular shape may be fused, as shown in the drawing. It is also possible to affix a reinforcing material composed of a sheet or a film to the reinforcement sections 11, 12. In the case of the present embodiment, the packaging object is not particularly limited.

As previously stated, after being sealed along G, G' in the square-shaped bag with the original shape, unsealing (tearing) is carried out along the unsealing guides A-C, B-D when the contents are to be used. The first sealing section 2 of the side A-C and the second sealing section 3 of the side B-D of the packaging bag ABDC are composed of a folding line, seal line, a perforated line, or the like and act as the unsealing guide. It is preferred that the side A-C and the side B-D that act as the unsealing guide to be machined in advance so as to readily unseal (tear).

Figure 5:
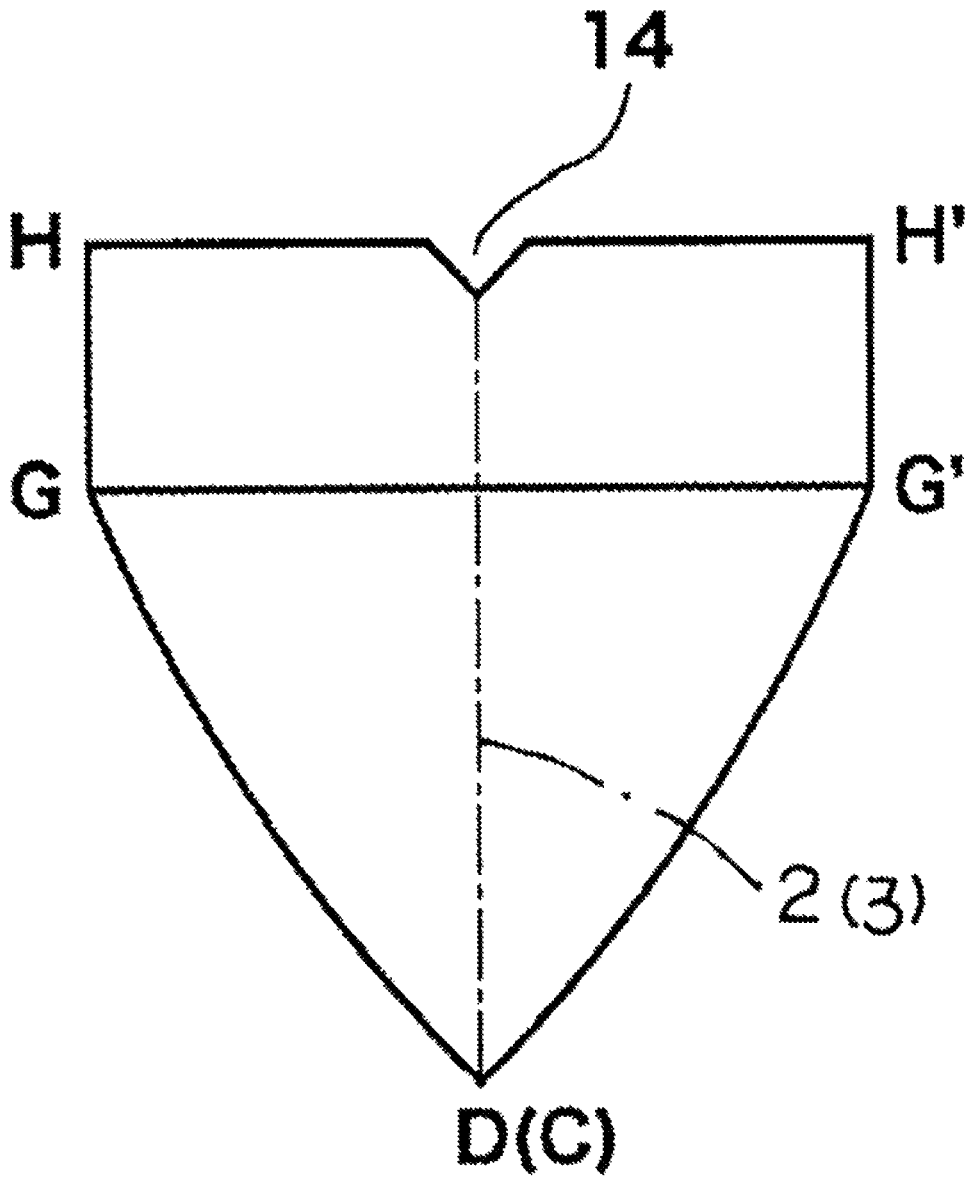
FIG. 5 is a descriptive view of an embodiment of the present invention.

For example, it is preferred that the side A-C and side B-D be acted on with force to form fold lines, thermocompression bonded at a low temperature, or provided with linear holes such as a perforated line to allow for facilitated unsealing (tearing). It is preferred that a cut 14 or another perforated line, a hole, or the like positioned on the end section of the band 13 be provided at the center section of the side H-H' and positioned on the extension of the first and second sealing sections 2, 3, which are the unsealing guide, as shown in FIG. 5, so as to be capable of readily unsealing (tearing) along the side A-C and side B-D of the unsealing guide.

In the case that the contents are, e.g., a salad or a vegetable such as spinach or lettuce, it is also possible to seal a pocket in which dressing is placed together with the lettuce, spinach, or salad in a state in which the unsealing guide in the tetrahedral package material is shared with the packaging container, and to provide with a partition so that the dressing is applied to the lettuce, spinach, or salad as the contents at the same time the packaging bag is opened, and the contents can then be eaten.

With the packaging container 6 configured in the manner described above, in the case that the bag assembly 1 that has one open side is formed, the first and second sealing sections 2, 3 are formed on two sides that face four sides, and the sealing sections 2, 3 form the fourth sealing section 5 and have a tetrahedral shape. At this time, the sections are positioned above the perpendicular line of the pair of first and second triangular shapes (GG'C), (GG'D). As a result, the first sealing section and second sealing section 2, 3 can be used as an unsealing guide for tearing. In other words, in the case of the present embodiment, the packaging container 6 can be readily unsealed without the adoption of special means by using the first and second sealing sections 2, 3, which are necessary when the bag assembly 1 is formed.

Figure 6:
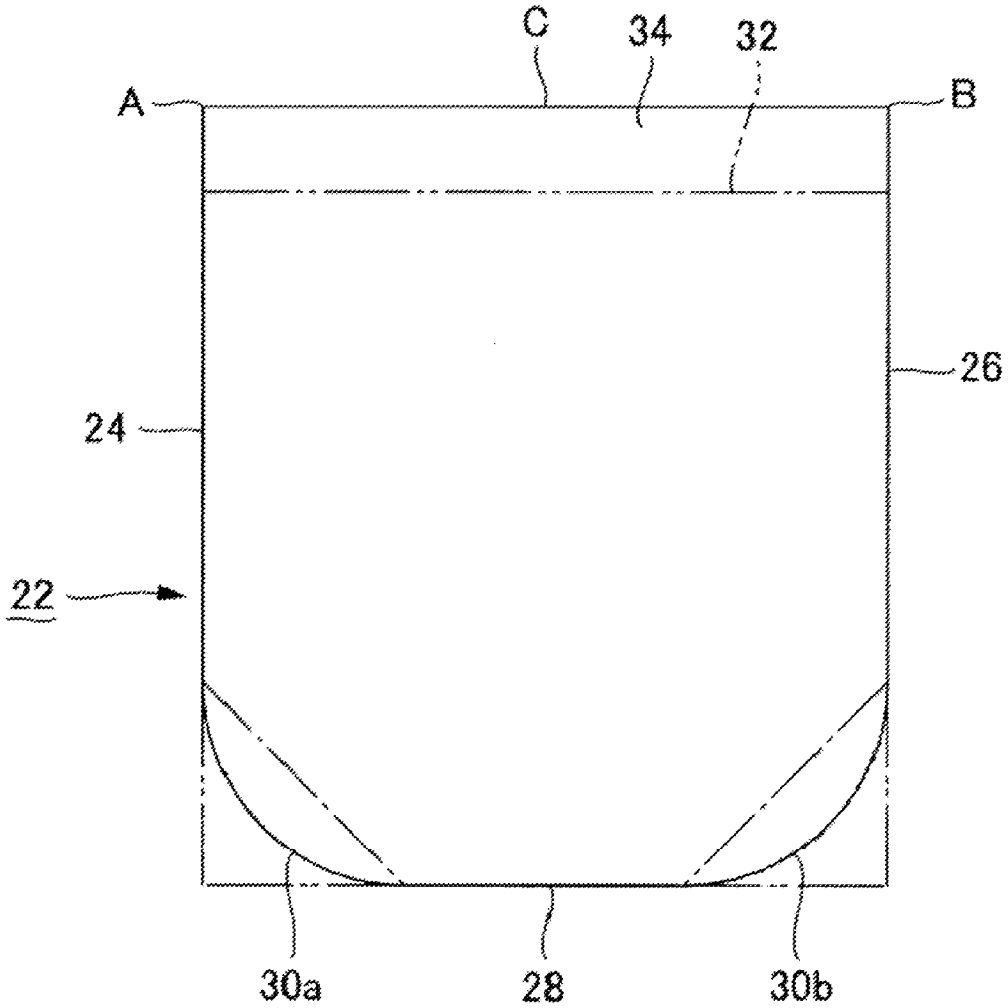
FIG. 6 shows another embodiment of the bag assembly used as the packaging container of the present invention.

FIGS. 6 through 11 show other embodiments of the packaging container according to the present invention. FIG. 6 shows a bag assembly 22 that is used as a packaging container 20 of the present embodiment. The bag assembly 22 is a single long narrow film or sheet folded at the lower end to form superimposed rectangle shapes, and a first and second sealing sections 24, 26 are formed at the pair of two sides (side surfaces) facing each other.

In the same manner as the above-described embodiments, it is possible to use a transparent, semi-transparent, or colored resin film or resin sheet as the material of the bag assembly 22, a double layer or triple layer laminate can also be used as necessary and a resin to which a UV absorber has been added may be used to reduce the transmissivity of UV rays.

In the case of the present embodiment, the first and second sealing sections 24, 26 are formed by a heat seal line in which the end surfaces of the film (sheet) have been fused together by cutting the film (sheet) with a hot blade. The sealing sections 24, 26 may be a heat seal line in which the surfaces of the film are bonded to each other by thermocompression in lieu of a heat-seal line between end surfaces.

The bag assembly 22 has a third sealing section 28 composed of a fold line formed on one side (lower end) of the remaining two sides, and the remaining one side (upper end) is open. In the case of the present embodiment, a pair of arcuate corner-pull seal lines 30*a*, 30*b* is provided at the two ends of the third sealing section 28. The corner-pull seal lines 30*a*, 30*b* are composed of thermocompression-bonded seal lines.

One of the corner-pull seal lines 30*a* is formed so as to connect between the first sealing section 24 and the left end side of the third sealing section 28, and the other corner-pull seal line 30*b* is formed so as to connect between the second sealing section 26 and the right end side of the third sealing section 28.

Figure 7:
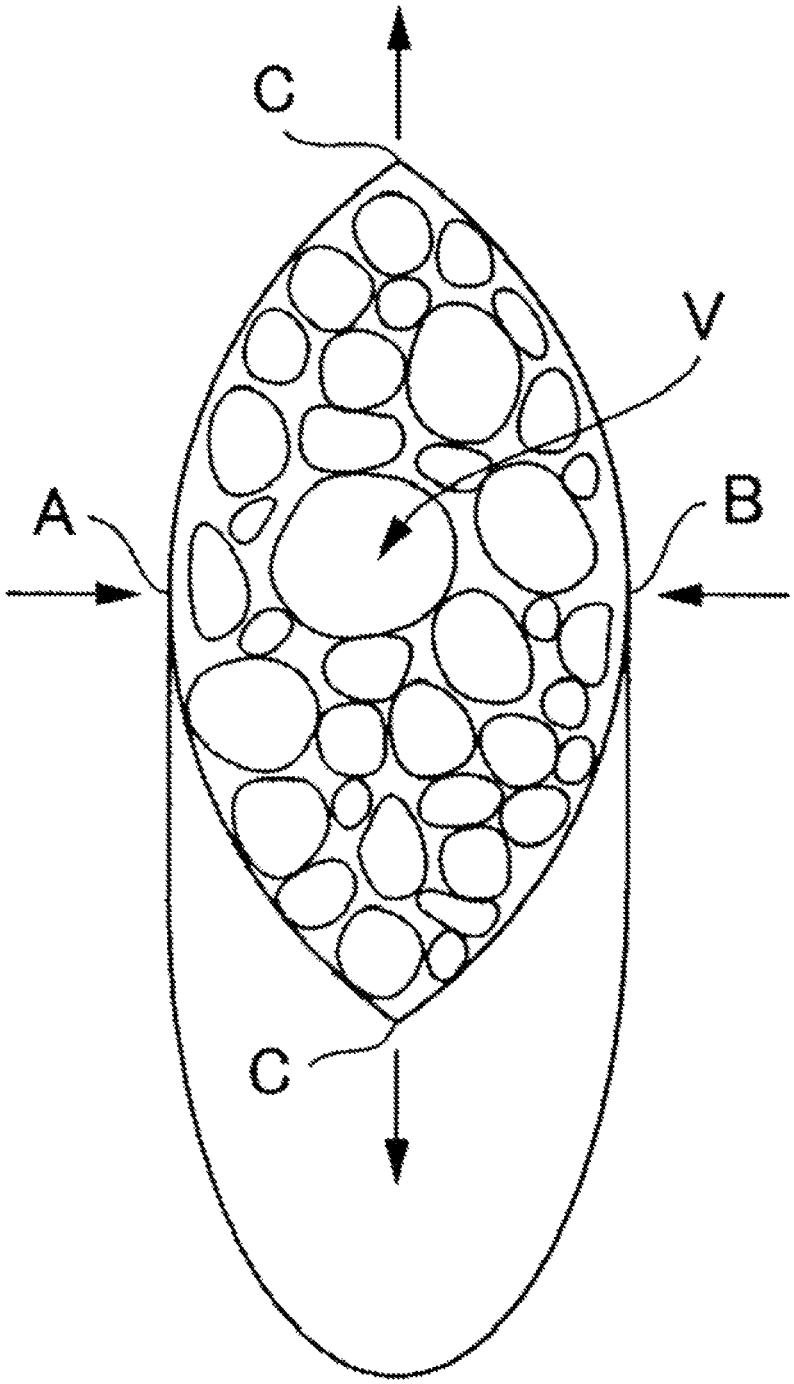
FIG. 7 is a descriptive view of when the vegetables are placed inside the bag assembly shown in FIG. 6.

The third sealing area 28 may be a seal fine formed by thermocompression bonding in lieu of a fold line. When the bag assembly 22 such as that described above is formed, the packaging object is introduced through the upper end open section into the bag assembly 22. In this case, a center portion C of the upper end opening of the bag assembly 22 is torn apart in the forward/rearward direction, the two ends A, B of the upper end opening are brought closer to one another, the opening section is opened, and a prescribed amount of a leafy vegetable V is inserted in this state, as shown in FIG. 7.

The leafy vegetables V may be a cut vegetable in which, e.g., lettuce, spinach, broccoli, Japanese mustard spinach, green soybean, or any type of leafy vegetable has been cut to the prescribed size. The vegetables are arranged in a diameter of about, e.g., 5 to 10 cm, and the leafy vegetables V are randomly placed so that portions overlap each other. The upper end opening of the bag assembly 22 is sealed when placement of the leafy vegetables V is completed.

Figure 8:
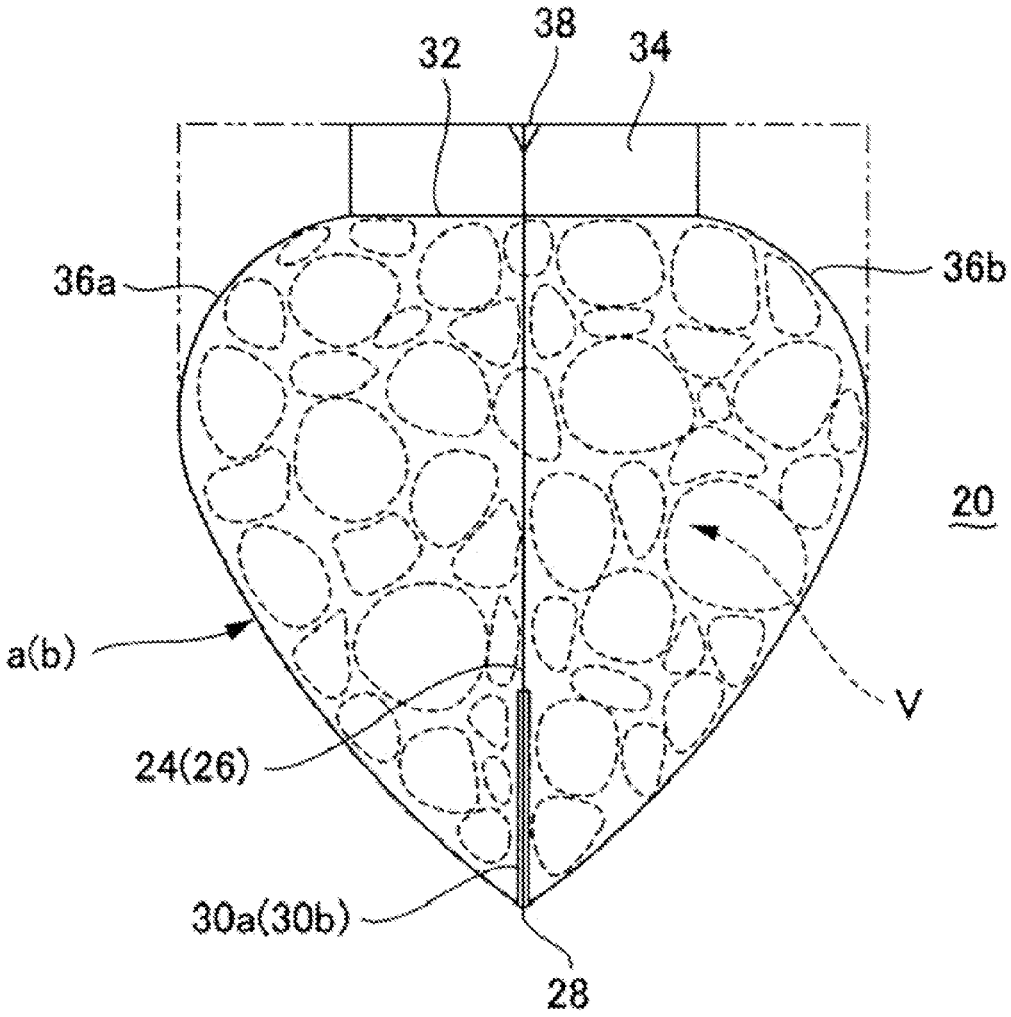
FIG. 8 is a lateral view of the packaging container shown in FIG. 6.
Figure 9:
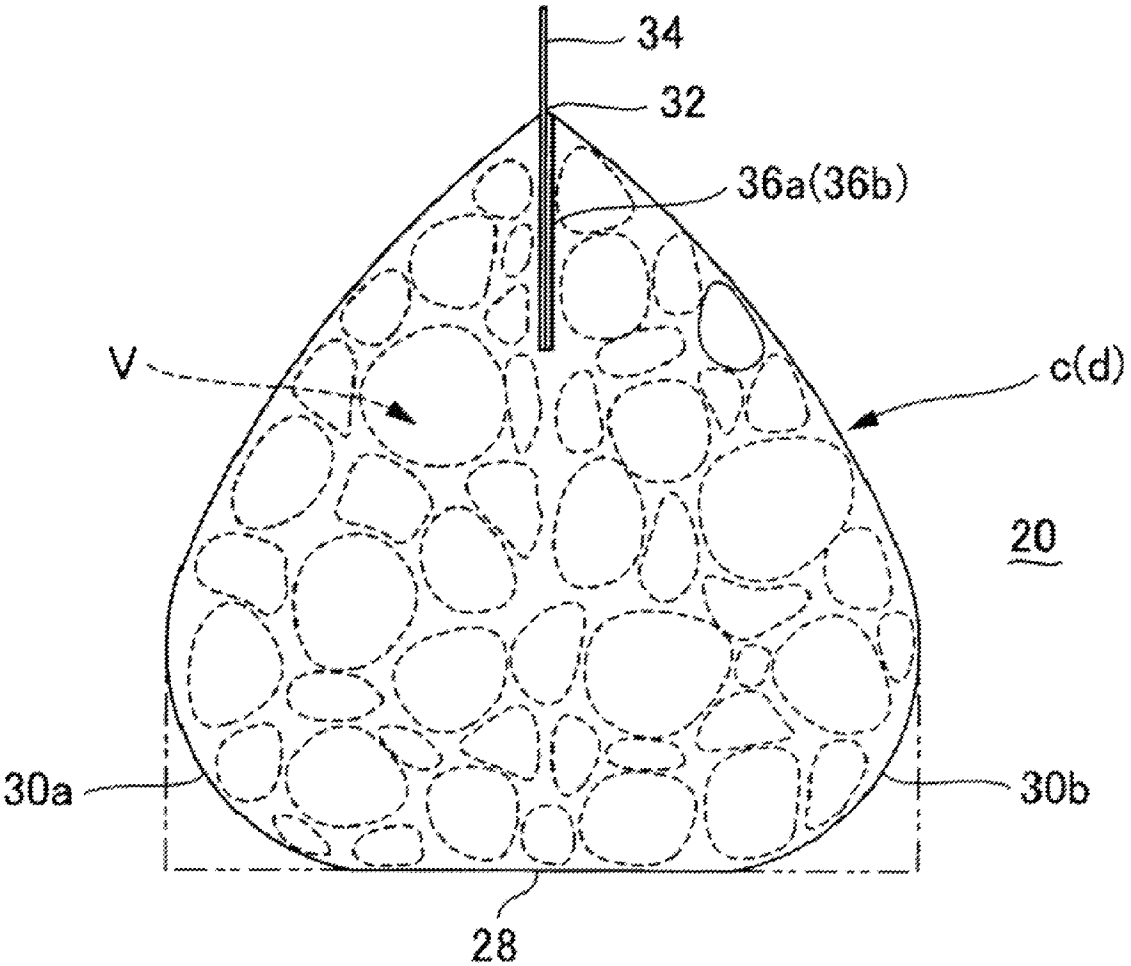
FIG. 9 is a lateral view of a different direction of the packaging container shown in FIG. 6.

The sealed state of the bag assembly 22 is shown in the FIGS. 8 and 9. The open section of the bag assembly 22 is sealed by forming a fourth sealing section 32. The fourth sealing section 32 is formed by, e.g., a thermocompression-bonded seal line, and is formed at an angle that is substantially orthogonal to the third sealing section 28.

The fourth sealing section 32 is disposed in a position that is set at a distance downward from the upper end of the bag assembly 22, and an ear section (band) 34 is provided to the upper end of the fourth sealing section 32. Additionally, in the case of the present embodiment, a pair of arcuate corner-pull seal lines 36*a*, 36*b* is provided to the two ends of the fourth sealing section 32. The corner-pull seal lines 36*a*, 36*b* are composed by a thermocompression-bonded seal line in the same manner as the above-described seal lines 30*a*, 30*b*.

One of the corner-pull seal lines 36*a* is formed so as to connect between the first sealing section 24 and the left end side of the fourth sealing section 32, and the other corner-pull seal line 36*b* is formed so as to connect between the second sealing section 26 and the right end side of the fourth sealing section 32.

Figure 10:
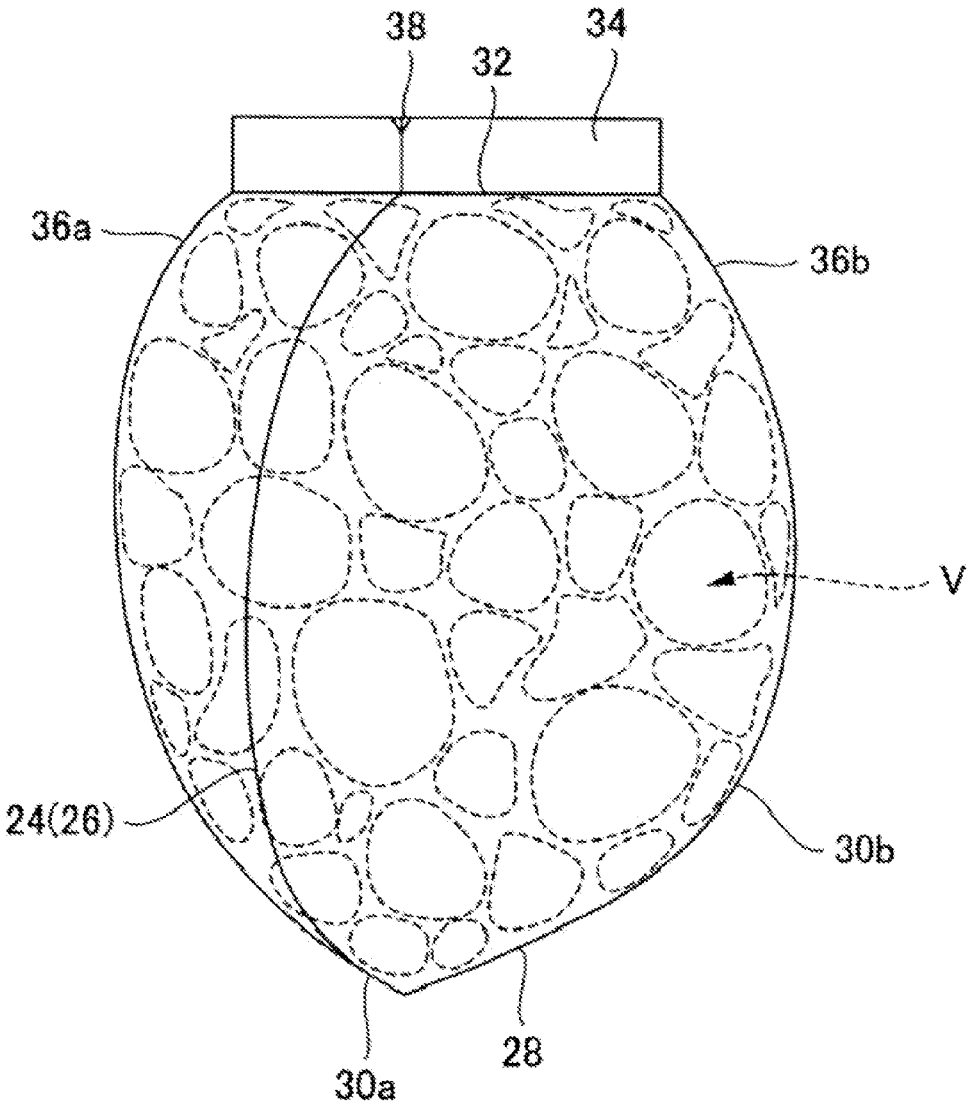
FIG. 10 is a perspective view of the packaging container shown in FIG. 6.

In the manner described above, when the fourth sealing section 32 and the corner-pull seal lines 36*a*, 36*b* are formed, as shown in FIGS. 8 through 10, the pair of first and second substantially triangular shapes a, b that have the fourth sealing section 32 as the common bottom side (described as substantially triangular because the arcuate corner-pull seal lines 36*a*, 36*b* are interposed between the oblique side and the bottom side of the triangle), and the pair of third and fourth substantially triangular shapes c, d that have the third sealing section 28 as the common bottom side (described as substantially triangular because the arcuate corner-pull seal lines 30*a*, 30*b* are interposed between the oblique side and the bottom side of the triangle) are formed.

The substantially triangular shapes a through d have the oblique sides connected in the circumferential direction to form a tetrahedral shape, and act as the packaging container 20 in which the leafy vegetable V as the packaging object is sealed inside together with air.

In the packaging container 20 configured in this manner, the first and second sealing sections 24, 26 are positioned on the substantially perpendicular line of the first and second substantially triangular shapes a, b, as shown in FIG. 8, and the thermocompression bond or the hot-blade seal line are used as the unsealing guide for tearing of the packaging container 20.

Figure 11:
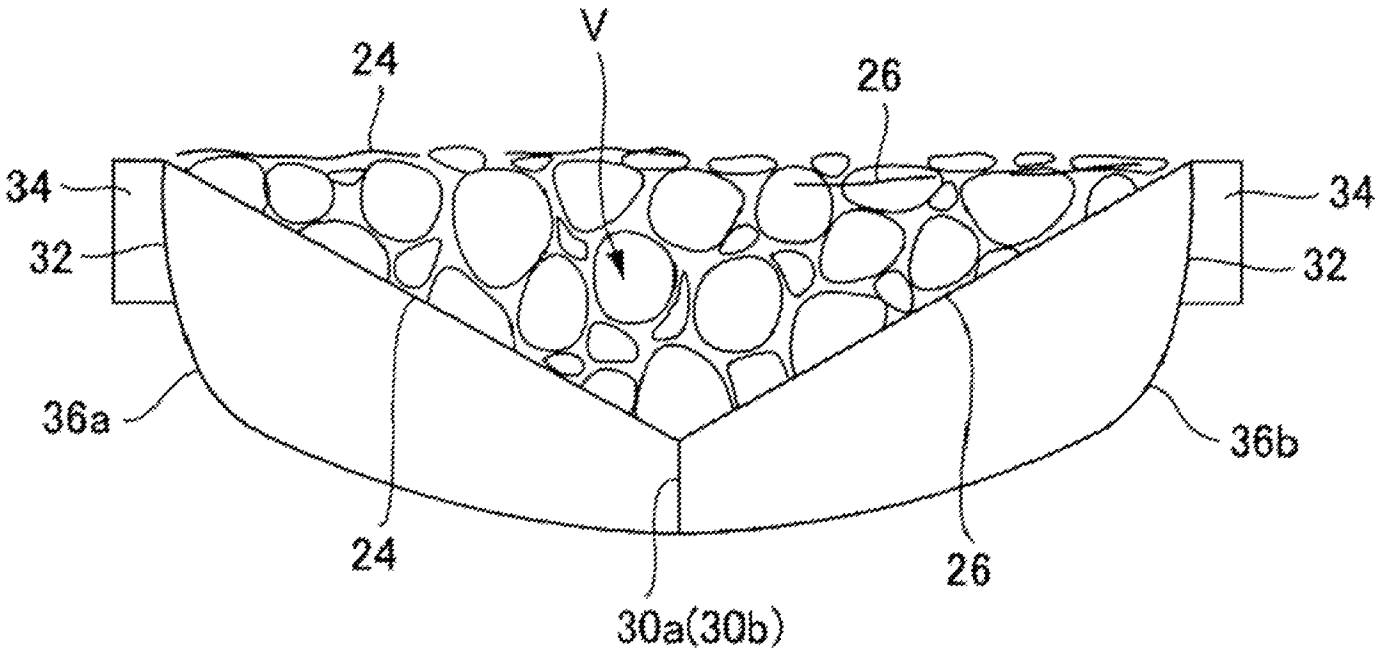
FIG. 11 is a descriptive view of the packaging container shown in FIG. 6 in an unsealed state.

FIG. 11 shows a state in which the packaging container 20 has been torn along the seal line wherein the first and second sealing sections 24, 26 are used as the unsealing guide. In the case of the present embodiment, a notch 38 positioned on the extension line of the sealing section 24, 26 is provided in the center position of the ear section (band) 34 in order to further facilitate the tearing operation.

A boat-type shape is formed using the third and fourth substantially triangular shapes c, d as the bottom side and the side surfaces erected at the rim when the first and second sealing 24, 26 are torn to the position of the corner-pull seal lines 30*a*, 30*b*, respectively, as shown in FIG. 11. The side surfaces in this case are formed by dividing the first and second substantially triangular shapes a, b on a substantially perpendicular line.

In this case, the leafy vegetable V placed inside the packaging container 20 is inside the boat shape, and the upper area of the boat shape is open. The body can therefore function as a boat-shaped plate, and the vegetables can be eaten without further preparation. In accordance with the packaging container 20 configured in the manner described above, since the packaging container 20 that has air sealed in together with lettuce, spinach, or another leafy vegetable V is provided with the corner-pull seal lines 30*a*, 30*b*, 36*a*, and 36*b* at all corner sections of the tetrahedral body, the corner sections in which leafy vegetable V enter and are readily damaged are eliminated, and, as a result, the freshness of the leafy vegetable can be maintained for a long time.

In the packaging container 20 having the above-described configuration, the first and second sealing sections 24, 26 composed of a heat-seal line formed on two opposing sides of the four sides thus form the fourth sealing section 32 and present a tetrahedral shape in the case that the bag assembly 22 that has one open side is formed. When this is done, the sections are positioned on a perpendicular line of the pair of first and second triangular shapes c, d, and as a result, the heat-seal lines can be used as an unsealing guide for tearing.

Additionally, with the packaging container 20 having the above-described configuration, lettuce, spinach, or another leafy vegetable V is the packaging object, and when this object is sealed inside the packaging container 20 whose basic shape is a tetrahedral body, the body does not have parallel or opposing surfaces. Therefore, when an external force is applied, the external force is dispersed, and damage to the leafy vegetable can be reduced without external force being applied unchanged to the leafy vegetable V as in the case where the vegetables are sealed in a box-shaped packaging container.

Also, in the packaging container 20 having the above-described configuration, lettuce, spinach, or another leafy vegetable V is the packaging object sealed together with air inside the packaging container 20 whose basic shape is a tetrahedral body. Therefore, air layers are interposed between adjacent vegetables and between the vegetables on the surface and the bag assembly 22. Accordingly, when external force is applied, the air layers function as a cushion and can act to reduce damage to the leafy vegetable.

A case is shown as an example in the above-described embodiment in which corner-pull seal lines 30*a*, 30*b*, 36*a*, 36*b* are formed in an arc and each of the seal lines can be straight lines, as shown by the alternate long and short dash line in, e.g., FIGS. 6 and 8. Also, the marginal portions of the external sides of each corner-pull seal line 30*a*, 30*b*, 36*a*, 36*b* that are shown by an imaginary line in FIGS. 6 and 8 can be cut away and removed along the seal lines or may be left unchanged. The packaging object described as a leafy vegetable is not limiting and may also be a readily damaged object, e.g., potato chips or another food item; beads or another sundry item; or the like.

With the packaging container of the present invention, using a sealing section required when the bag assembly is formed makes it possible to unseal the bag assembly more easily without adopting special means, to reduce labor and costs, to further enhance value as a packaging container, and to widely use the packaging container in the industrial field.

The invention claimed is:

1. A packaging container having a tetrahedral-shaped bag assembly, a) the packaging container being formed i) by closing two opposing sides of a pair of resin film or sheet portions of at least one resin film or sheet facing each other by using a first seam or folded portion formed between first and second corners of the first seam or folded portion, and a second seam or folded portion formed between first and second corners of the second seam or folded portion;

ii) by closing one side of the other two sides of said pair of film or sheet portions facing each other by using a third seam or folded portion between the first corner of the first seam or folded portion and the first corner of the second seam or folded portion; and iii) by closing the other side of said other two sides of said pair of film or sheet portions by a fourth seam that is substantially orthogonal to the third seam or folded portion as a result of bringing together and joining the second corner and an adjacent portion of the first seam or folded portion and the second corner and an adjacent portion of the second seam or folded portion to form joined first and second seam portions;

b) a band of material of said container having a length and having predetermined width at a distance along said length that is coincident with said joined first and second seam portions; and c) the first and second seams or folded portions being so constructed as to each be easily torn apart for opening of the packaging container, wherein the first and second seams or folded portions are used as respective unsealing portions along a majority of respective lengths of the first and second seams or folded portions, including along the entirety of said band, so as to form a boat shape with one band portion forming a bow of the boat and the other band portion forming the stern of the boat and a bottom portion of the boat including a central portion of the third seam.

2. The packaging container according to claim 1, wherein said first seam and second seam are heat-fused.

3. The packaging container according to claim 1, wherein said bottom face of said boat shape forms a substantially diamond shape.

4. The packaging container according to claim 1, wherein the band portion forming a bow of the boat and the band portion forming the stern of the boat have substantially equal lengths.

5. The packaging container according to claim 1, wherein an upper surface of a boat edge of said boat shape is a tearing apart portion.

6. A method for forming a packaging container having a tetrahedral-shaped bag assembly, comprising:

a) closing two opposing sides of a pair of resin film or sheet portions of at least one resin film or sheet facing each other by using a first seam or folded portion formed between first and second corners of the first seam or folded portion, and a second seam or folded portion formed between first and second corners of the second seam or folded portion, so as to form a partially formed enclosure;

b) placing one or more packaging objects into the partially formed enclosure, and then closing one side of the other two sides of said pair of film or sheet portions facing each other by using a third seam or folded portion between the first corner of the first seam or folded portion and the first corner of the second seam or folded portion;

c) closing the other side of said other two sides of said film or sheet portion by a fourth seam that is substantially orthogonal to the third seam or folded portion as a result of bringing together and joining the second corner and an adjacent portion of the first seam or folded portion and the second corner and an adjacent portion of the second seam or folded portion to form joined first and second seam portions;

d) providing a band of material of said container having a length and having predetermined width at a distance along said length that is coincident with said joined first and second seam portions; and e) opening the packaging container so as to form a boat shape with one band portion forming a bow of the boat and the other band portion forming the stern of the boat and a bottom portion of the boat including a central portion of the third seam, by having the first and second seams or folded portions being so constructed as to each be easily torn apart, by using the first and second seams or folded portions as respective unsealing portions along a majority of respective lengths of the first and second seams or folded portions, including along the entirety of said band, so as to form a boat shape with one band portion forming a bow of the boat and the other band portion forming the stern of the boat and a bottom portion of the boat including a central portion of the third seam.

7. The method of claim 6, wherein the step of closing two opposing sides heat-fuses the first seam and the second seam.

8. The method of claim 6, wherein the step of opening the packaging container forms the boat shape having a bottom face of a substantially diamond shape.

9. The method of claim 6, wherein the step of opening the packaging container further includes providing substantially equal lengths for both the band portion forming a bow of the boat and the other band portion forming the stern.

10. The method of claim 6, wherein the step of opening the packaging container uses an upper surface of a boat edge of said boat shape as a tearing apart portion.

* * * * *